US010689849B2

(12) United States Patent
Swinea et al.

(10) Patent No.: US 10,689,849 B2
(45) Date of Patent: Jun. 23, 2020

(54) ATTACHMENT OF FURRING STRIPS TO FLOOR JOISTS

(71) Applicant: UNITED STATES GYPSUM COMPANY, Chicago, IL (US)

(72) Inventors: Joseph Swinea, Mundelein, IL (US); Gary Miller, Palatine, IL (US); Frank Pospisil, Oak Park, IL (US); James Ullett, McHenry, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 0 days.

(21) Appl. No.: 16/261,193

(22) Filed: Jan. 29, 2019

(65) Prior Publication Data

US 2019/0383010 A1 Dec. 19, 2019

Related U.S. Application Data

(60) Provisional application No. 62/684,354, filed on Jun. 13, 2018.

(51) Int. Cl.
*E04B 9/18* (2006.01)

(52) U.S. Cl.
CPC ..... *E04B 9/18* (2013.01)

(58) Field of Classification Search
CPC ..... E04B 9/18
USPC ..... 52/650.1
See application file for complete search history.

(56) References Cited

U.S. PATENT DOCUMENTS 1,994,322 A * 3/1935 O'Neil ..... E04B 9/18 403/209
2,901,062 A * 8/1959 Rice ..... E04B 5/10 52/783.15
3,333,387 A * 8/1967 Deakins ..... E04B 9/127 52/664
3,748,808 A * 7/1973 Sheppard ..... E04B 9/16 52/665
4,091,845 A * 5/1978 Johnson ..... B21F 1/002 140/106
4,519,564 A * 5/1985 Nadherny ..... F16L 3/14 24/115 H
5,364,053 A * 11/1994 Rodgers ..... E04B 9/18 248/302
7,743,572 B2 * 6/2010 Ducharme ..... G10K 11/16 52/167.1
8,667,756 B1 * 3/2014 Sareyka ..... E04B 9/18 52/506.06

(Continued)

FOREIGN PATENT DOCUMENTS

FR 1441910 A * 6/1966 ..... E04B 1/4185

*Primary Examiner* — Babajide A Demuren
(74) *Attorney, Agent, or Firm* — Greer, Burns & Crain, Ltd.; Philip Petti; Pradip Sahu

(57) ABSTRACT

An attachment system is provided for attaching furring strips to joists, each such joist having a bottom surface, an upper surface and a sidewall. The attachment system for each furring strip including a fastener having a shaft and a head, the fastener secured to the sidewall of the joist in a position vertically displaced from the bottom surface. At least one length of wire is provided with a mid-portion and two free ends, the mid-portion being looped around the fastener. The free ends are wrapped around the furring strip and fastened to each other to securely hold the furring strip to the floor joist.

18 Claims, 4 Drawing Sheets

(56) References Cited

U.S. PATENT DOCUMENTS

| | | | | |
|---|---|---|---|---|
| 2007/0292229 | A1* | 12/2007 | Andrew | E04B 9/18<br>410/101 |
| 2008/0283708 | A1* | 11/2008 | Bernard | E04B 9/18<br>248/343 |
| 2013/0042560 | A1* | 2/2013 | Platt | E04B 9/18<br>52/506.06 |

* cited by examiner

ATTACHMENT OF FURRING STRIPS TO FLOOR JOISTS

RELATED APPLICATION

The present application claims 35 USC 119 priority from U.S. Provisional Application Ser. No. 62/684,354 filed Jun. 13, 2018, which is incorporated by reference.

BACKGROUND

The present invention relates to building interior construction techniques, and more specifically to the construction of ceiling support systems beneath floor joists.

While traditionally, floor joists were made of solid wooden planks measuring 2"×10" or 2"×12", more modern construction techniques have replaced the solid wooden planks with composite solid wooden "I" beams or even solid steel "C"-channel joists. In conventional practice, furring strips, typically made of steel, and also referred to as "hat channel" strips, are fastened to undersides of the joists using fasteners, preferably screws. The fasteners pass through flanges of the furring strips and engage the underside of the joist. Next, wallboard panels, whether gypsum-based or made of other materials, including but not limited to structural cement, or other more water-resistant materials, are secured to the furring strips, by fasteners such as nails or screws. In many cases, multiple layers of wallboard panels are secured to the furring strips to create a ceiling, as is well known in the art.

To comply with local building codes, structures need to meet certain fire test standards promulgated by Underwriters Laboratories (UL) or ASTM International (ASTM). The fire test procedures and criteria differ with the geographic location and the type of construction. In conducting fire tests of ceiling assemblies attached to joists, it has been found that when steel "C"-channel joists and steel furring strips are constructed, during a regulated fire test, the furring strips tend to react to thermal expansion by bending or deforming, which cause breaches in the ceiling panels attached to the furring strips. Since wallboard panels often have fire retardant properties, once the ceiling panels are breached, the ceiling system succumbs to fire more rapidly than when the ceiling panels remain intact. In some cases, due to this bending or deforming of the furring strips, such systems have failed the designated fire test.

Thus, there is a need for providing an improved ceiling system attached to joists, which addresses the above-identified drawback.

SUMMARY

The above-listed need is met or exceeded by the present fastening system for attaching furring strips to floor joists. Although any type of floor joists is contemplated, the preferred embodiment is contemplated for use with steel "C"-joists. An important feature of the present system is that the furring strips are not rigidly attached to the joist, but instead are secured in a way that permits linear or axial expansion, as occurs during a fire. This relatively looser attachment is achieved by using lengths of metal wire which are looped around a fastener, preferably a screw which is installed in the joist in a position vertically displaced, or above the bottom of the joist. After looping the wire around the screw, free ends of the wire are wrapped around the furring strip, drawing it tightly against the bottom of the joist. This technique has been found to sufficiently attach the furring strips to the joist to support the subsequent installation of wallboard panels, but also allows for linear or axial expansion of the furring strips relative to the joist during fires, which also maintains the integrity of the ceiling panels for an extended period, which is desired during fire tests.

More specifically, an attachment system is provided for attaching furring strips to joists, each such joist having a bottom surface, an upper surface and a sidewall. The attachment system for each furring strip includes a fastener having a shaft and a head, the fastener secured to the sidewall of the joist in a position vertically displaced from the bottom surface. At least one length of wire is provided with a mid-portion and two free ends, the mid-portion being looped around the fastener. The free ends are wrapped around the furring strip and fastened to each other to securely hold the furring strip to the floor joist.

In a preferred embodiment, the fastener, which is preferably a steel self-tapping screw, is partially installed in the joist so that a portion of the shaft is exposed. In addition, the fastener is inserted into the joist approximately 8 inches from the bottom of the joist. Also preferred is that the at least one length of wire is a pair of strands of wire, and that the free ends of the strands are fastened to each other by twisting them together.

In another embodiment, a method of attaching furring strips to joists is provided, each such joist having a bottom surface, an upper surface and a sidewall. The method for each furring strip includes installing a fastener having a shaft and a head into the sidewall of the joist in a position vertically displaced from the bottom surface; threading at least one length of wire with a mid-portion and two free ends so that the mid-portion is looped around the fastener, and the free ends are wrapped around the furring strip; and fastening the wire free ends to each other to securely hold the furring strip to the floor joist.

DETAILED DESCRIPTION

Figure 1:
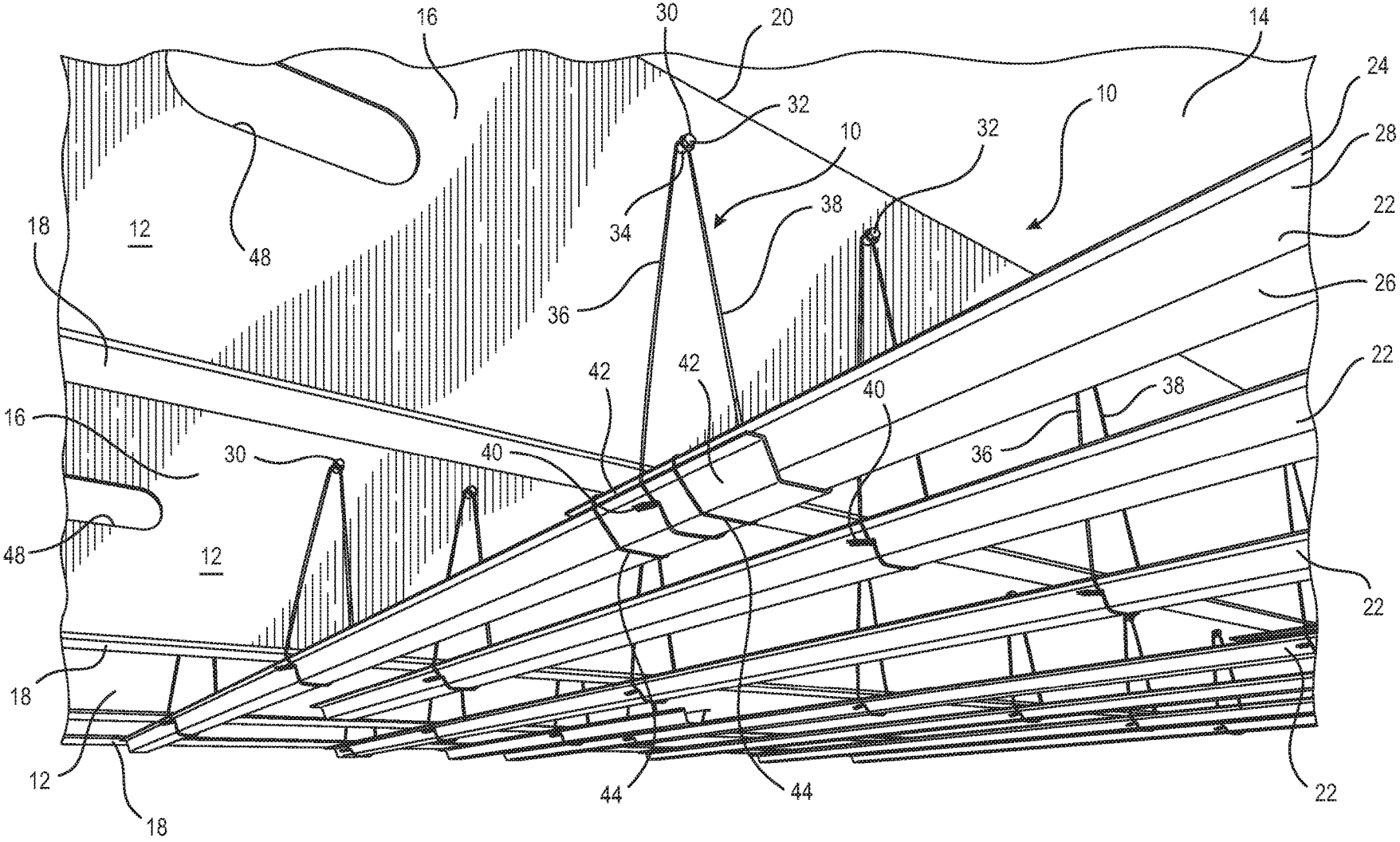
FIG. 1 is a bottom perspective view of a furring strip installation to joists including the present fastening system.

Referring now to FIGS. 1-4, the present attachment system, generally designated 10, is for use in installing a ceiling below a plurality of joists 12 arranged in spaced, parallel orientation for supporting a subfloor 14 as well as upper stories of the building in question. While it is contemplated that the joists 12 are made of solid wood planks, a manufactured composite solid wood "I"-beam or solid metal, in the preferred embodiment, the joist 12 is a steel "C"-joist or channel-shaped joist, a minimum 9.25-inch deep and fabricated at least from No. 16 (0.016 inch) MSG galvanized steel. It is preferred that the joists 12 are spaced a maximum 24 inches apart, but this distance may vary to suit the application or local building codes. In the present application, "solid" refers to a joist that has a solid sidewall 16, and is not an open-truss design, which is an alternate joist configuration in some applications. Also provided on the joist 12 is a bottom surface 18 and an upper surface 20 in contact with the subfloor 14.

Figure 4:
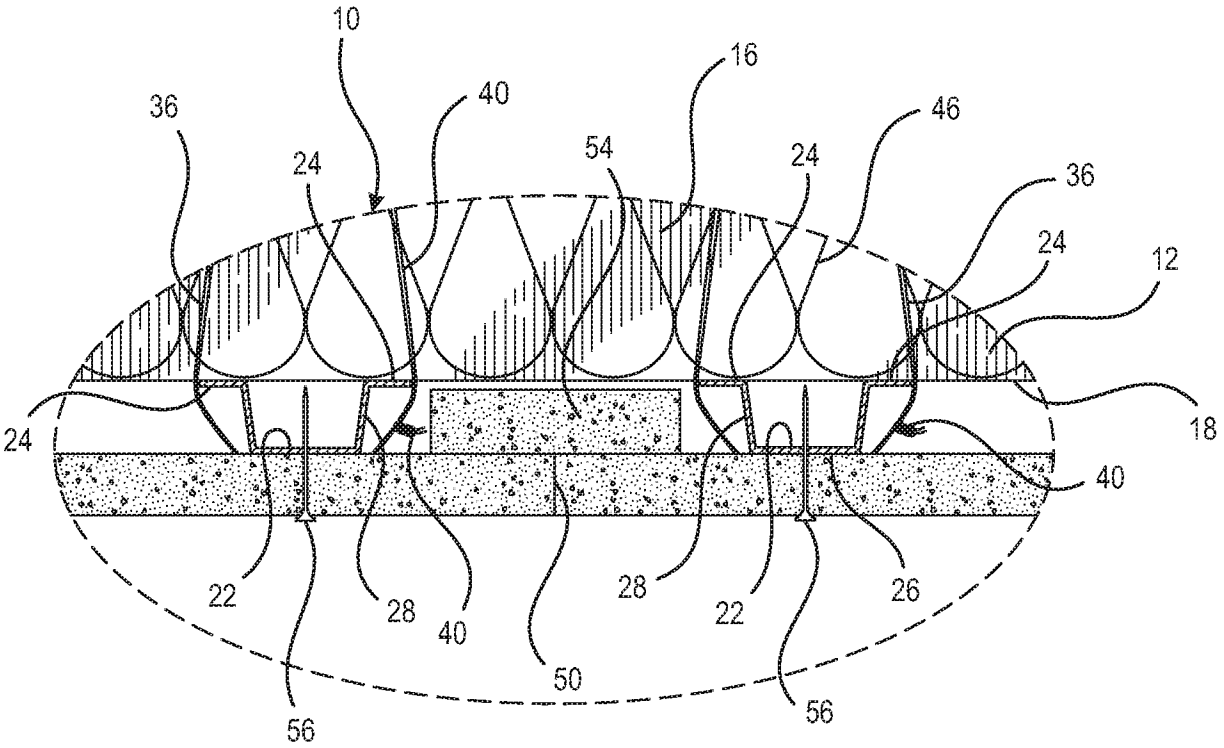
FIG. 4 is a fragmentary enlarged portion of FIG. 3.

In constructing a ceiling, it is customary that a plurality of furring strips 22 are secured to the bottom surface 18 of each of the joists 12. The furring strips 22 are also referred to as "furring channel" or "hat channel." The latter designation refers to the cross-sectional shape of the channel, having a pair of generally co-planar flanges 24 separated by a vertically displaced crown 26, which in turn is supported on the flanges by a pair of inclined walls 28 (FIG. 4).

The inclined walls 28 displace the crown 26 approximately ⅞-inch or 1.5 inches from the flanges 24, depending on the application. In the preferred embodiment, the furring strips 22 are made of a minimum 20 MSG galvanized steel, at least 2⅝ in. wide by at least ⅞ in. deep. In conventional construction techniques, the flanges 24 are secured to the bottom surface 18 of the joist 12 using specialized fasteners, such as self-tapping or drill tipped screws. As discussed above, such construction techniques have resulted in poor performance in fire tests due to warping of the furring strips 22 when exposed to heat, which warping then causes the ceiling made of wallboard panels to be breached, facilitating fire damage.

A feature of the present system 10 is that a fastener 30, preferably a steel, self-tapping screw, and more preferably a No. 10×¾ inch steel self-tapping screw with a head 32 and a shaft 34 is secured to or threadably inserted into the joist sidewall 16. While other locations are contemplated, it is preferred that the fastener 30 is vertically displaced from the joist bottom surface 18. It is still further preferred that the fastener 30 is installed approximately 8 inches from the joist bottom surface. In the present application, in this context, "approximately" refers to ±2 inches, depending on the size of the joist 12. In the preferred embodiment, the fastener 30 is partially inserted into the joist sidewall 16 so that a portion of the fastener shaft 34 is exposed.

In the present system 10, the purpose of partially inserting the fastener 30 into the joist sidewall 16 is to provide a support location for at least one length or strand of wire 36 having a mid-portion 38 and two free ends 40. In the present application, "mid-portion" in this context refers to the approximate half-length point, and up to the middle third of the strand of wire 36. In the preferred embodiment, the wire 36 is steel wire, more specifically No. 18 Standard Wire Gauge (SWG) galvanized steel wire. However, other grades and materials of wire are contemplated depending on the application. The wire mid-portion 38 is looped or threaded around the fastener 30, more specifically the exposed fastener shaft 34. In addition, the wire free ends 40 are wrapped around the furring strip 22 and joined to each other so that the furring strip is drawn tight and securely held against the joist bottom surface 18. It is especially preferred that the free wire ends 40 are secured together by twisting them together around each other, preferably several times, to form a helical twisted coil.

In a further preferred embodiment, two lengths or strands of wire 36 are used together and are wrapped around the fastener 30 as shown in FIG. 1. Also seen in FIG. 1 is an overlap of ends 42 of two furring strips 22. In addition to the fastening system 10, the overlapping ends 42 are secured to each other by separate strands of wire 44, each wire wrapped around both ends and twisted in a saddle format, as is known in the art.

The present fastening system 10 is contemplated as being installed as follows. First, installing a fastener 30 having a shaft 34 and a head 32 into the sidewall 16 of the joist 12 in a position vertically displaced from the bottom surface 14. Next, threading or looping at least one length of wire 36 with a mid-portion 38 and two free ends 40 so that the mid-portion is looped around the fastener, and the free ends are wrapped around the furring strip 22. Lastly, fastening the wire free ends 40 to each other to securely hold the furring strip 22 to the floor joist 12.

Figure 2:
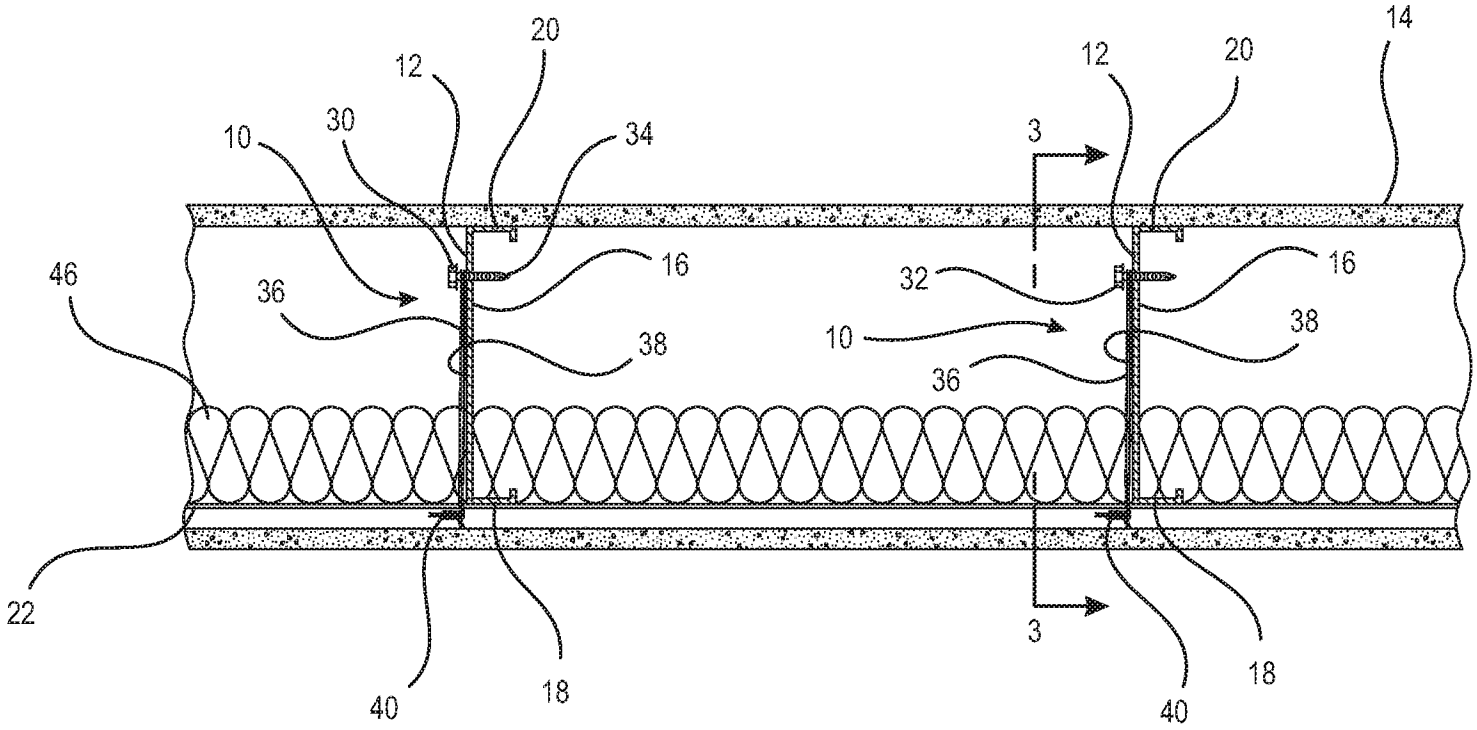
FIG. 2 is a fragmentary vertical cross-section of a joist assembly disclosing the present fastening system.
Figure 3:
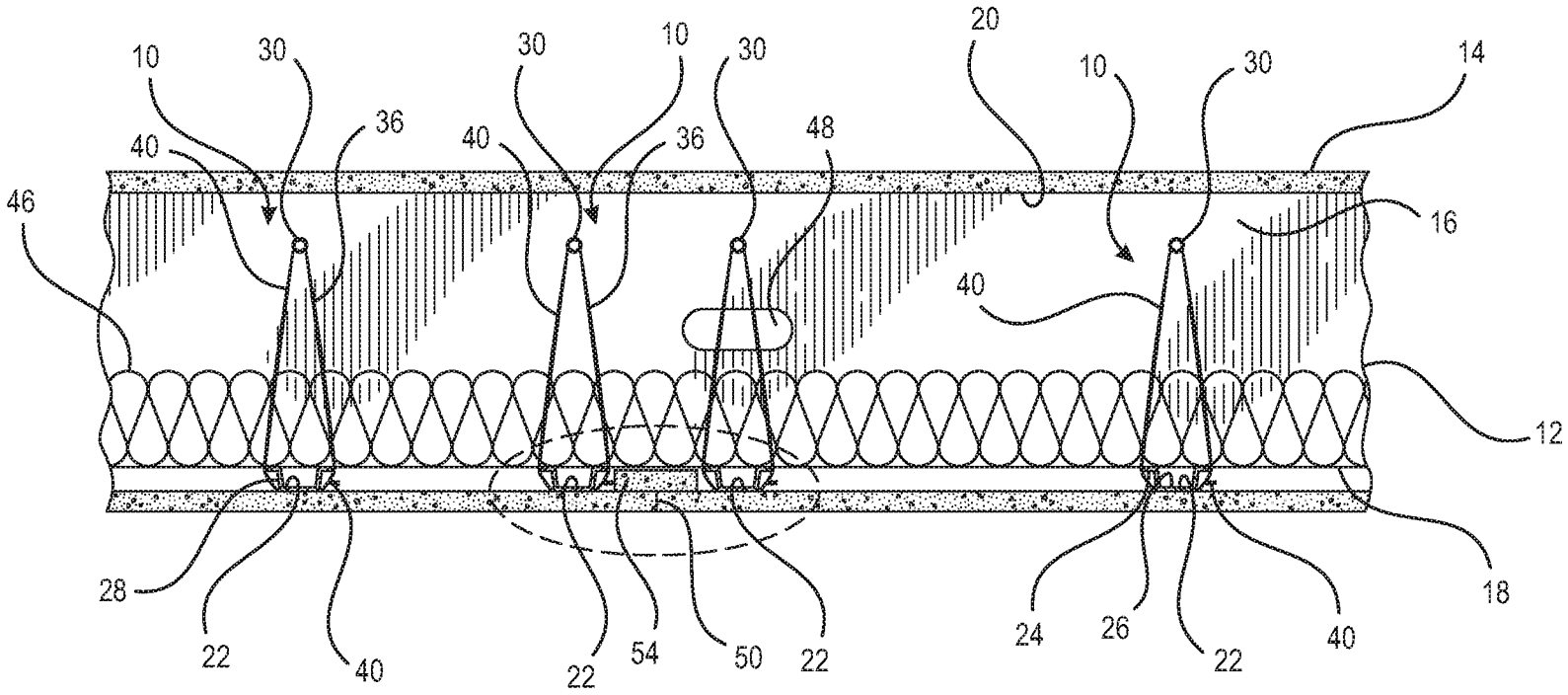
FIG. 3 is a fragmentary vertical cross-section taken along the lines 3-3 of FIG. 2 and in the direction generally indicated.

Referring now to FIGS. 2-4, bats of insulation 46 are optionally placed above the furring strips 22. Also, as is known in the art, the joist sidewall 16 is provided with optional cutouts 48 for access of electrical wiring, cabling, plumbing lines, or the like. As a further protection against fire damage, seams 50 formed by adjacent, butting wallboard panels 52 are optionally covered by longitudinal strips 54 of wallboard material. The strips 54 are preferably inserted above the seams 50 after the panels 52 are secured to the furring strips 22 using fasteners 56 such as nails or screws as is well known in the art. Once in place, the strips 54 are also secured to the adjacent panels 52 using the fasteners 56 or chemical adhesive.

While a particular embodiment of the present fastening system for attaching furring strips to floor joists has been described herein, it will be appreciated by those skilled in the art that changes and modifications may be made thereto without departing from the invention in its broader aspects and as set forth in the following claims.

The invention claimed is:

1. An attachment system for attaching furring strips to steel C-channel joists, each such joist having a bottom surface, an upper surface, and a sidewall, the attachment system for each furring strip comprising:

a fastener having a shaft and a head, said fastener secured to the sidewall of the joist in a position vertically displaced from the bottom surface;

at least one length of wire with a mid-portion and two free ends, said mid-portion being looped around the fastener, and said free ends being fastened to each other and said at least one length of wire surrounding said fastener and the furring strip in a single continuous loop; and said wire free ends being fastened to each other so that the furring strip is in direct contact with the bottom surface of the joist to securely hold the furring strip to the floor joist.

2. The attachment system of claim 1, wherein said fastener is partially installed in the joist so that a portion of said shaft is exposed.

3. The attachment system of claim 1, wherein said fastener is a No. 10×¾ inch steel self-tapping screw.

4. The attachment system of claim 1, wherein said fastener is installed approximately 8 inches from the bottom of the joist.

5. The attachment system of claim 1, wherein said at least one length of wire further includes a pair of strands of wire.

6. The attachment system of claim 1, wherein said at least one strand of wire is metal wire.

7. The attachment system of claim 6, wherein said at least one strand of wire is No. 18 SWG steel wire.

8. The attachment system of claim 1, wherein said wire free ends are joined by twisting an equivalent length of each end around each other.

9. A method of attaching furring strips to steel C-channel joists, each such joist having a bottom surface, an upper surface, and a sidewall, the method for each furring strip comprising:

installing a fastener having a shaft and a head into the sidewall of the joist in a position vertically displaced from the bottom surface;

threading at least one length of wire with a mid-portion and two free ends so that the mid-portion is wrapped around the fastener and the furring strip in a single continuous loop positioned transverse to the furring strip, and the free ends are twisted around each other; and fastening the wire free ends to each other so that the furring strip is in direct contact with the bottom surface of the joist to securely hold the furring strip to the floor joist.

10. The method of claim 9, further including fastening said fastener approximately 8 inches from the bottom of the joist.

11. The method of claim 9, further including providing a pair of strands of wire as said at least one length of wire.

12. The method of claim 9, further including fastening said wire free ends together by twisting an equivalent length of each of the ends around each other.

13. The attachment system of claim 8, wherein said wire free ends are joined adjacent to the furring strip.

14. The attachment system of claim 8, wherein the wire free ends are joined to each other between upper and lower ends of one side of the furring strip.

15. The method of claim 11, further including fastening said wire free ends together adjacent to the furring strip.

16. The method of claim 15, further including fastening said wire free ends to each other adjacent a side of the furring strip between upper and lower ends of the furring strip.

17. The attachment system of claim 1, wherein said at least one length of wire is positioned transverse to the furring strip.

18. An attachment system for attaching furring strips to steel C-channel joists, each such joist having a bottom surface, an upper surface, and a sidewall, the attachment system for each furring strip comprising:

a fastener having a shaft and a head, said fastener secured to the sidewall of the joist in a position vertically displaced from the bottom surface, approximately 8 inches from the bottom of the joist, partially installed in the joist so that a portion of said shaft is exposed;

at least one length of wire with a mid-portion and two free ends, said mid-portion being looped around the fastener and said free ends being fastened to each other;

said at least one length of wire surrounding said fastener and the furring strip in a single continuous loop positioned transverse to the furring strip;

said wire free ends being fastened to each other so that said wire free ends are joined adjacent to the furring strip, between upper and lower ends of one side of the furring strip, and so that the furring strip is in direct contact with the bottom surface of the joist to securely hold the furring strip to the floor joist; and said wire free ends are joined by twisting an equivalent length of each end around each other.

* * * * *